US011470902B2

(12) United States Patent
Tokko

(10) Patent No.: US 11,470,902 B2
(45) Date of Patent: Oct. 18, 2022

(54) HAIR EXTENSION ANCHOR FASTENING DEVICE

(71) Applicant: The Hair Shop, Inc., Los Angeles, CA (US)

(72) Inventor: Ryan Tokko, Los Angeles, CA (US)

(73) Assignee: THE HAIR SHOP, INC., Los Angeles, CA (US)

( * ) Notice: Subject to any disclaimer, the term of this patent is extended or adjusted under 35 U.S.C. 154(b) by 135 days.

(21) Appl. No.: 16/791,440

(22) Filed: Feb. 14, 2020

(65) Prior Publication Data

US 2020/0260810 A1 Aug. 20, 2020

Related U.S. Application Data

(63) Continuation-in-part of application No. 16/354,200, filed on Mar. 15, 2019.

(60) Provisional application No. 62/807,736, filed on Feb. 19, 2019, provisional application No. 62/814,805, filed on Mar. 6, 2019.

(51) Int. Cl.
*A41G 5/00* (2006.01)

(52) U.S. Cl.
CPC ..... *A41G 5/0073* (2013.01); *A41G 5/0086* (2013.01)

(58) Field of Classification Search
CPC ..... A41G 5/0073; A41G 5/0086
USPC ..... 132/53, 54, 55
See application file for complete search history.

(56) References Cited

U.S. PATENT DOCUMENTS 4,108,183 A * 8/1978 Mauro ..... A45D 2/148 132/250
4,254,784 A * 3/1981 Nelson ..... A41G 5/0013 132/53
5,004,865 A * 4/1991 Krupnicki ..... H01R 4/20 174/15.6
5,121,761 A * 6/1992 Meister ..... A41G 5/0053 132/201
5,354,210 A * 10/1994 Koblitz ..... C08L 53/005 439/276
5,775,341 A * 7/1998 Abe ..... A41G 5/006 132/201
6,148,829 A * 11/2000 De Benedictis ..... A45D 2/08 132/207
6,263,884 B1 * 7/2001 Minnelli ..... A45D 8/34 132/201
6,276,368 B1 * 8/2001 Giamalva ..... A45D 8/36 132/201
6,691,714 B1 * 2/2004 Yaguchi ..... A41G 3/0033 132/201
6,711,749 B2 3/2004 White et al.
(Continued)

*Primary Examiner* — Nicholas D Lucchesi
(74) *Attorney, Agent, or Firm* — Lewis Roca Rothgerber Christie LLP

(57) ABSTRACT

A hair extension anchor fastening device includes hair anchor tubes, which has a tube wall. The tube wall includes a top opening, a bottom opening, a first hole and a second hole that is opposite to the first hole. A wire passes through the holes of the hair anchor tubes whereby the hair anchor tubes can slide along the wire. Hair fixing devices are provided. The hair fixing device includes a bead thread forming a loop and a bead handle that connects both ends of the bead thread and the bead thread passes through the hair anchor tube. The device may be provided as attached to a hair weft by sewing a hair weft band through the holes of the tube wall or sewing the wire to the weft band.

15 Claims, 14 Drawing Sheets

(56) References Cited

U.S. PATENT DOCUMENTS 7,174,900 B2 * 2/2007 Lane ..... A41G 5/004 132/273
7,458,383 B2 12/2008 Song
8,127,775 B2 3/2012 Tokko
8,944,076 B1 * 2/2015 Doubt ..... A41G 5/0073 132/201
9,033,196 B1 * 5/2015 Smith ..... A41G 5/0086 223/102
9,241,524 B2 1/2016 Burchard
9,491,978 B2 11/2016 Kim
2003/0226571 A1 12/2003 Rahman
2003/0234027 A1 * 12/2003 Smith ..... A41G 5/0066 132/201
2004/0149302 A1 8/2004 Toda
2004/0231689 A1 * 11/2004 Kobayashi ..... A45D 7/06 132/222
2005/0011530 A1 * 1/2005 Chang ..... A41G 5/0046 132/53
2005/0061346 A1 * 3/2005 Song ..... A41G 5/004 132/201
2006/0027244 A1 * 2/2006 Nomura ..... A41G 5/0066 132/201
2007/0277839 A1 12/2007 Rodriguez
2008/0011314 A1 1/2008 Arroyo et al.
2008/0236605 A1 10/2008 Russo
2009/0056731 A1 * 3/2009 Tokko ..... A41G 5/0066 132/53
2010/0059079 A1 * 3/2010 Tokko ..... A41G 5/0066 132/201
2010/0275940 A1 11/2010 Kallabat et al.
2011/0056507 A1 * 3/2011 Tokko ..... A41G 5/008 132/201
2011/0247643 A1 * 10/2011 Tokko ..... A41G 5/0066 132/201
2012/0234338 A1 9/2012 Verbonac
2012/0298127 A1 11/2012 Yi
2013/0255707 A1 * 10/2013 Oh ..... A41G 5/006 132/201
2014/0338689 A1 11/2014 Shuttleworth
2015/0083154 A1 3/2015 Lindsay
2016/0235149 A1 8/2016 Seawright
2017/0135432 A1 5/2017 Williams et al.
2017/0360134 A1 12/2017 Crocilla
2020/0113262 A1 * 4/2020 Tokko ..... A41G 5/0066

* cited by examiner

HAIR EXTENSION ANCHOR FASTENING DEVICE

CROSS-REFERENCE TO RELATED APPLICATIONS

This application claims priority on the inventor's patent application Ser. No. 16/354,200 filed on Mar. 15, 2019, Provisional Application No. 62/807,736 filed on Feb. 19, 2019, and Provisional Application No. 62/814,805 filed on Mar. 6, 2019, the disclosures of which are incorporated by reference.

BACKGROUND OF THE INVENTION

1. Field of the invention

The present invention is related to a hair extension fixing device. More particularly, the present invention is related to a hair extension anchor fastening device and method for attaching a hair extension to a customer's natural hair with ease and precision.

2. Discussion of Related Technology

Generally, the hair extension technology connects one or more extension hair pieces to the natural hair of a person. The extension hair pieces are to make the person's hair look longer or thicker and/or add color accents to the person's hair. The extension hair pieces for the hair extension come in various forms and shapes, and include hair weaves, widgets, etc. In order to attach hair extension(s) to customer's natural hair, various methods, such as using metal tubes, double-sided tape, hair pins are used. The handling, storing and organizing of the extension hair pieces require a lot of care, as the extension hair pieces are expensive.

US2017/0360134 to CROCILLA discloses a hair extension, in which the aligned hairs are compressed into a narrowed tip section, which is used to fasten the hair extension to a person's natural hair, using a deformable member such as a micro ring.

US2015/0083154 to Lindsay discloses an apparatus that includes a weft of hair material, at least one ring and at least one T-anchor. The rings are made of a deformable material. The T-anchors couple the rings to the weft of hair material.

US2014/0338689 to Shuttleworth discloses an oblong-shaped bead that includes an exterior surface and an interior surface that defines a channel adapted to enclose a portion of the lock of the native hair and a tip of the hair extension.

US2012/0298127 to Yi discloses a hair fastener that engages the wearer's hair, and at least one hair extension that is indirectly connected to the hair fastener via a hair extension connector, such as a thin flexible loop made of thread, string, wire, ribbon, or fiber.

US2012/0234338 to Verbonac discloses a hair extension apparatus that adhesively secures a hair weft at areas of exposed skin behind a wearer's ears to avoid damage to the wearer's natural hair.

US2010/0275940 to Kallabat et al. discloses micro rings that are fixed to the skin weft and provide an anchoring feature for strands of human hair from the scalp to be secured thereto.

US2017/0135432 to Williams et al. discloses a hook for attaching the hair extension and a band that has a front surface and a back surface. A plurality of hair strands are attached to the back surface of the band and extend downwardly therefrom. The hair extension further includes an elongated retaining member attached to the front surface of the band at least one of intervals.

US2016/0235149 to Seawright discloses a method including the steps of providing a wefted hair extension having artificial hair, a sew-in needle and a thread pair extending therefrom. The method includes parting the person's natural hair so as to form a plurality of adjacent hair root sections forming a starter knot about a starter root section by looping the thread pair about the starter root section using the sew-in needle.

US2005/0011530 to Chang discloses an extension hair used to stage thin or short hair long. An upper inserting part of an flexible wire-form hair guiding loop, in which a hanging part is formed in the middle part. An inserting part and a drawing-out part are formed in the upper part and in the lower part, then is inserted from the lower part to the upper part of the hair connecting tube so that the inserting part is exposed toward the upper part of the hair connecting tube.

US2003/0226571 to Rahman discloses a plurality of artificial or human hair strands having a length, turned about a separate rod. The rod is used only to form the open loop. The rod is removed leaving a one embodiment hair extension, comprising of a length of hair having a first end with an open loop and a second end that is banded or tied.

US2008/0011314 to Arroyo discloses a system for applying hair extensions that have cylindrical tubes, a threading tool and a crimping tool.

US2004/0149302 to Toda discloses a hair-thickening hair material fixture that comprises a rubber or a resin, formed in a tube form, and can shrink by heating.

US2008/0236605 to Russo discloses passing strands of scalp hair through beads that are affixed to or integral with a seam of the weft hair extension apparatus; passing strands of scalp hair and stands of extension hair through at deformable locking beads; and, deforming the beads such that the strands of scalp hair and the strands of extension hair passed therethrough are then held captive therein.

US2007/0277839 to Rodriguez discloses a method including steps: determining a location around a scalp for attaching at least one extension hair; gathering a first group of original hair; inserting a portion of the first group of original hair in a first band; providing a first group of artificial support material; inserting a portion of the first group of the artificial support material in the first band, the combination of the first group of original hair and the first group of artificial support material forming a first hair combination; gathering a second group of original hair, the second group of original hair being substantially proximate to the first hair combination; inserting in a second band the combination of at least one hair from the second group of original hair and a portion of the first hair combination, the hairs in between the first and the second band defining a hair track; and attaching the extension hair to the hair track.

U.S. Pat. No. 9,491,978 to Kim discloses hair extension for attachment to a person's head including a plurality of hair sections held together by a track. The hair extension is configured such that the plurality of hair sections can move upward and downward freely with person's natural hair when styling.

U.S. Pat. No. 7,458,383 to Song discloses a plurality of space portions through which the real hair is passed between a pair of wig hair bundles that are bound to form the weft for hair extension and fixedly extends the real hair that is passed through the space portions to the weft for hair extension by use of a plurality of pressure rings.

U.S. Pat. No. 9,241,524 to BURCHARD discloses microcylinders and a top section of the plurality of hair bonded together to form the skin weft and i-tip.

U.S. Pat. No. 6,711,749 to White discloses a headwear in a substantially fixed position on the wearer's head irrespective of the exercise or amount of activity of the wearer.

U.S. Pat. No. 8,127,775 to Tokko discloses a rod that includes a base that is attached to a weft, and an extended portion that extends from the base and is adapted to be inserted into a tube for holding hair strands. The extended portion of the rod protrudes from the upper edge of the weft, and is bent toward the lower edge of the weft.

Attaching a hair extension to a customer's hair is a difficult and time-consuming task. If a heating device or a crimping device is used, preparing and handling the devices require care to avoid risk of hurting the hair and the scalp. Time required to secure the hair extension firmly and to provide natural appearance after securing depends on which method and device are used in attaching the hair extension. A hair extension attaching device and method that enables easy, fast and precise attachment work have long been in need. The foregoing discussion in this section is to provide general background information, and does not constitute an admission of prior art.

SUMMARY OF THE INVENTION

An objective of the invention is to provide an easy-to-use, precise, and strong attachment device and method for attaching hair extension to a customer's hair.

In order to achieve the objective, the present invention provides a hair extension anchor fastening device comprising at least one hair anchor tube(s) comprising a tube wall, a top opening and a bottom opening. The tube wall comprises a first hole and a second hole which is opposite to the first hole. The first hole and the second hole are located at a predetermined distance from the top opening.

The predetermined distance is one third of the tube wall's height. The hair anchor tube is made of malleable metal.

The hair extension anchor fastening device further comprises a wire that passes through the first hole and the second hole of the at least one hair anchor tube(s) whereby the hair anchor tube(s) can slide along the wire. The wire is made of metal or plastic.

The hair extension anchor fastening device's stoppers are located at both ends of the wire. The stoppers prevent the hair anchor tubes from falling off from the wire.

The hair extension anchor fastening device further comprises at least one hair-fixing device. The hair-fixing device comprises a bead thread forming a loop and a bead handle that connects both ends of the bead thread. The bead thread passes through the hair anchor tube, vertically. The loop of the hair fixing device extends out of the top opening of the hair anchor tube, and the bead handle is positioned below the bottom opening of the hair anchor tube.

The present invention also provides a hair extension comprising at least one hair weft(s) and the hair extension anchor fastening device. The hair weft comprises a plurality of extension hair strands, and a weft band that holds the extension hair strands. The hair weft is fixed to the hair extension anchor fastening device.

The hair weft is fixed to the hair extension anchor fastening device by sewing the weft band through the first hole and the second hole of the tube wall.

The present invention also provides a hair extension comprising at least one hair weft, wherein the hair weft comprises a plurality of extension hair strands, and a weft band that holds the extension hair strands, and at least one spring pin(s), wherein the spring pin is fixed to the weft band. The spring pin comprises an irreversible hook and a lock hook.

The present invention also provides a hair extension tube opening tool comprising a first half which comprises a first handle and a first tool tip and a second half which comprises a second handle and a second tool tip. The first half and the second half are pivotally connected. The first tool tip contacts the second tool tip when the hair extension tube opening tool is in a closed state. The first tool tip pivots away from the second tool tip when the hair extension tube opening tool is in an open state. The first tool tip comprises a first semi-circular recess and a first slot positioned about the center of the first semi-circular recess, and the second first tool tip comprises a second semi-circular recess and a second slot positioned about the center of the first semi-circular recess.

The advantageous effects of the present invention are: (1) the hair extension anchor fastening device provides a tight and comfortable feeling to the user because the hair anchor tube automatically finds its proper position while sliding along the wire; (2) various sizes of the hair extension anchor fastening devices are provided to match various sizes of hair wefts; (3) the wire provides friction with the hair strands to prevent falling out of the hair anchor tube; (4) the work is fast and easy, even for a unskilled user, because the hair anchor tube automatically finds its position.

BRIEF DESCRIPTION OF THE DRAWINGS

The accompanying drawings illustrate the best embodiments of the present invention. In the drawings.

DESCRIPTION OF PREFERRED EMBODIMENTS

Embodiments will be described in detail below. The accompanying drawings will be used for describing embodiments. For the sake of convenience of illustrating embodiments, thickness, length, diameter, size and other dimensions of components and/or hair would be illustrated or exaggerated to be different with those of actual components and/or hair, and the subject matter of this application is not limited to the illustrated embodiments.

Figure 1:
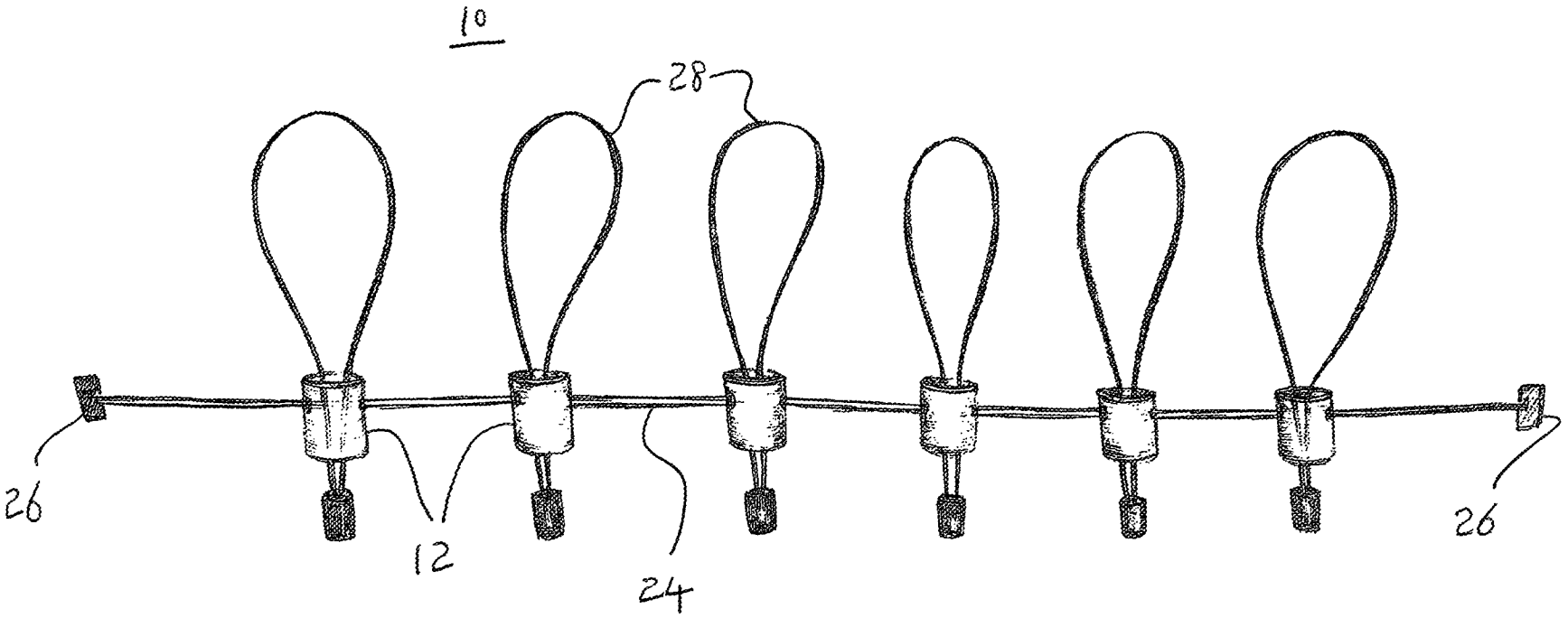
FIG. 1 is a perspective view showing a hair extension anchor fastening device, according to the present invention.
Figure 2:
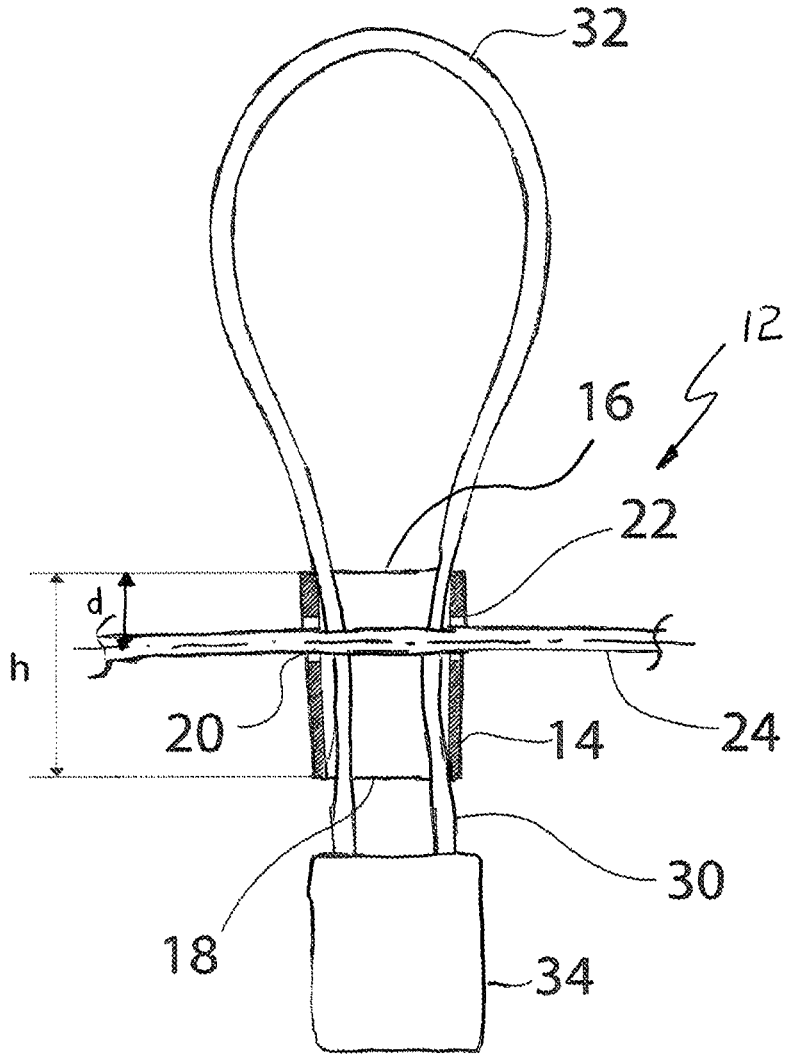
FIG. 2 is a sectional view showing a hair anchor tube.

Referring to FIGS. 1 and 2, a hair extension anchor fastening device 10 comprises at least one hair anchor tube(s) 12, which comprises a tube wall 14, a top opening 16, and a bottom opening 18, a first hole 20 and a second hole 22, which is opposite to the first hole 20. The first hole 20 and the second hole are 22 are located at a predetermined distance d from the top opening 16.

The predetermined distance d is one third of the tube wall's height h. The first hole 20 and the second hole 22 horizontally perforate the hair anchor tube 12. The hair anchor tube 12 is made of malleable metal.

The hair extension anchor fastening device 10 further comprises a wire 24 that passes through the first hole 20 and the second hole 22 of the at least one hair anchor tube(s) 12 whereby the hair anchor tube(s) 12 can slide along the wire 24. The wire 24 is made of metal including steel or plastic which includes synthetic nylon. The wire 24 may have a silicon coating surrounding a metal core. The length of the wire 24 and the number of the hair anchor tubes 12 vary according to the size of the hair weft, in which the hair extension anchor fastening device 10 is used.

The hair extension anchor fastening device 10 further comprises stoppers 26 at both ends of the wire 24. The stoppers 26 prevent the hair anchor tubes 12 from falling off from the wire 24. The stoppers 26 may be presented as a knot or a pressed tube.

The hair extension anchor fastening device 10 further comprises at least one hair-fixing device 28. The hair-fixing device 28 is pre-inserted through the bottom opening 18 of the tube wall 14. The hair fixing device 28 comprises a bead thread 30 forming a loop 32 and a bead handle 34 that connects both ends of the bead thread 30. The bead thread 30 passes through the hair anchor tube 12. The loop 32 of the hair fixing device 28 extends out of the top opening 16 of the hair anchor tube 12, and the bead handle 34 is positioned below the bottom opening 18 of the hair anchor tube 12.

Figure 3:
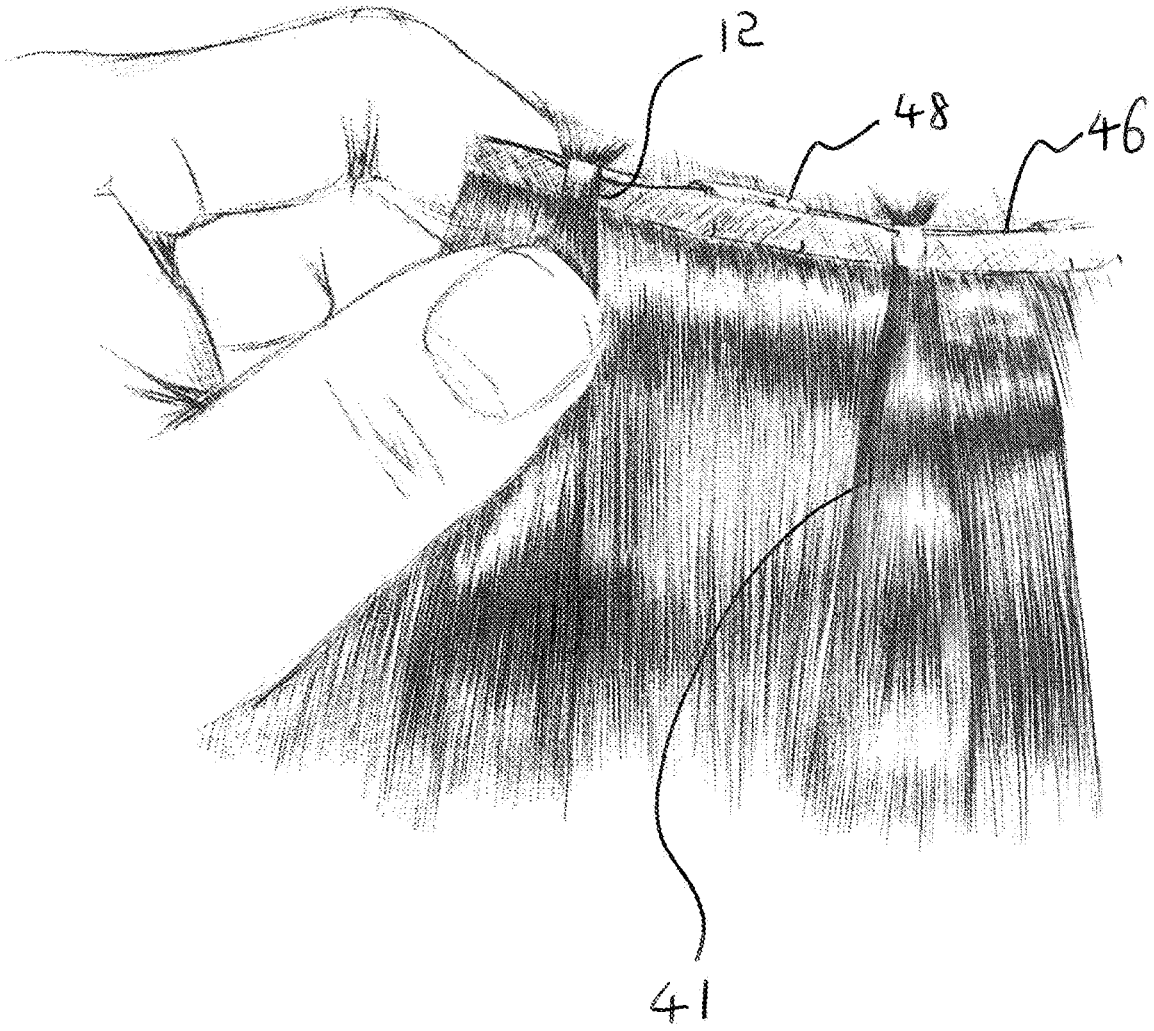
FIG. 3 is a perspective view showing a hair extension with the spring pins attached.
Figure 4:
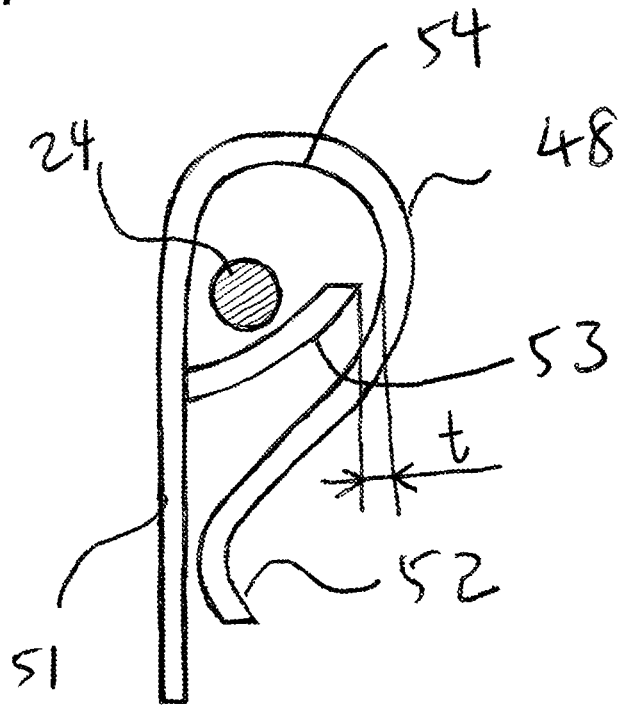
FIG. 4 is a side elevation view of the spring pin.
Figure 5:
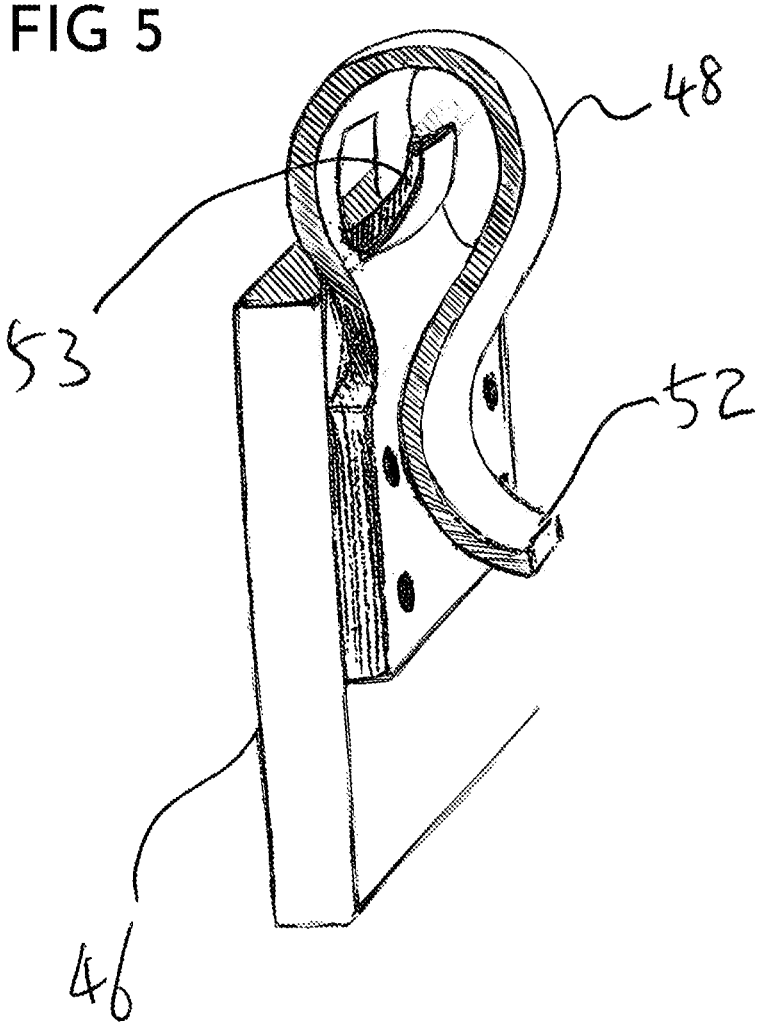
FIG. 5 is a perspective view of the spring pin.
Figure 6:
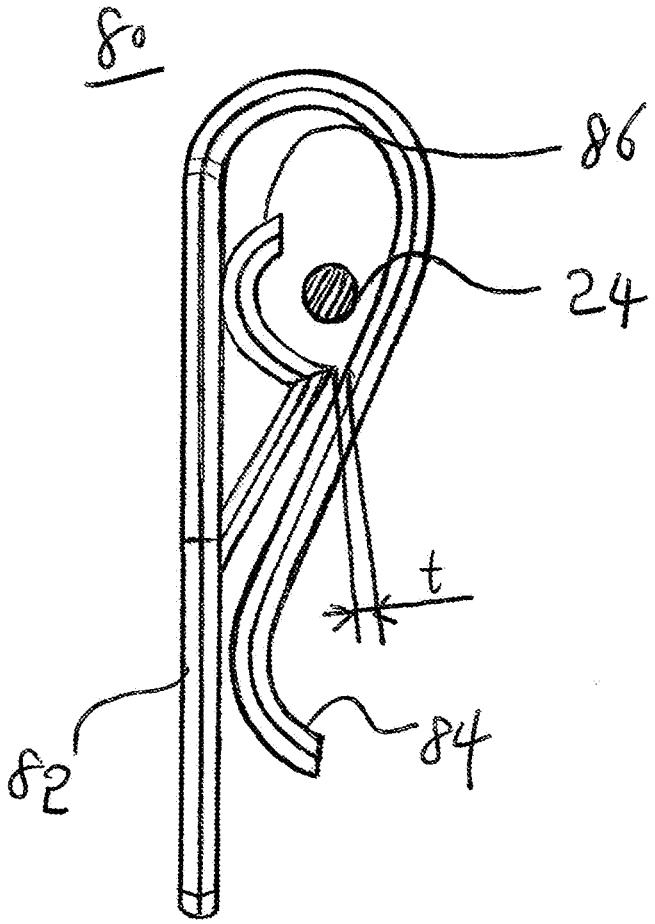
FIG. 6 is a side elevation view of another spring pin.
Figure 7:
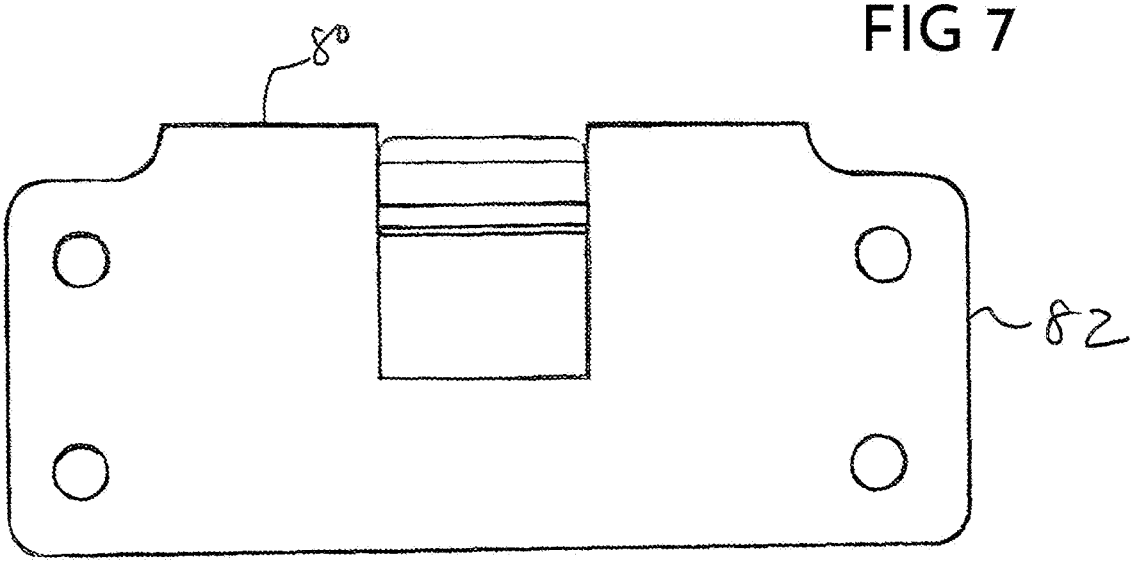
FIG. 7 is a front elevation view of the spring pin.
Figure 8:
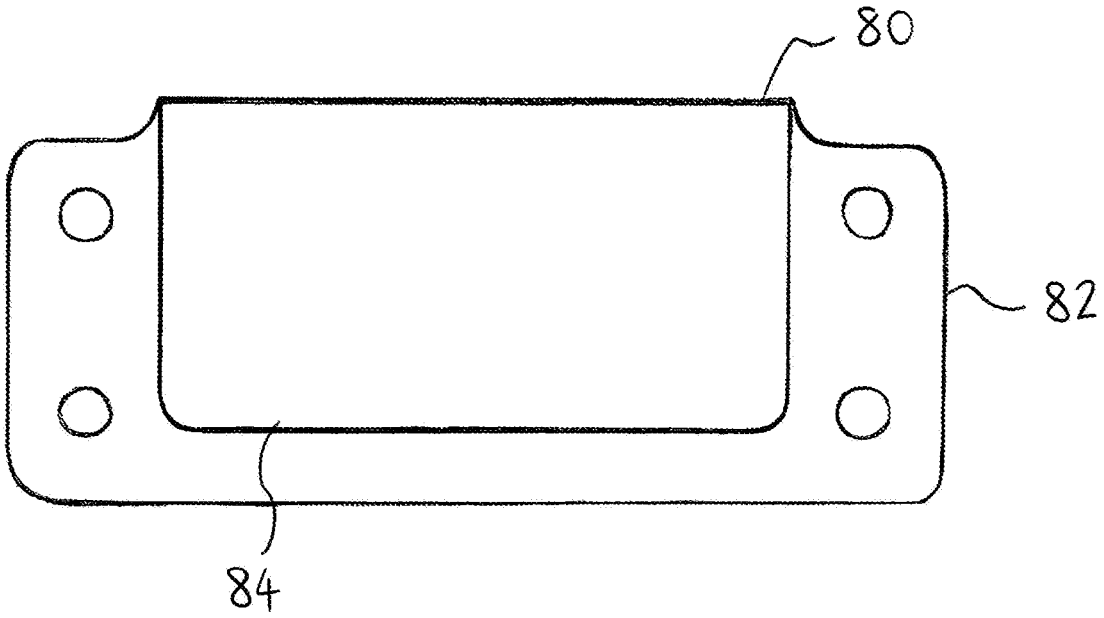
FIG. 8 is a rear elevation view of the spring pin.
Figure 9:
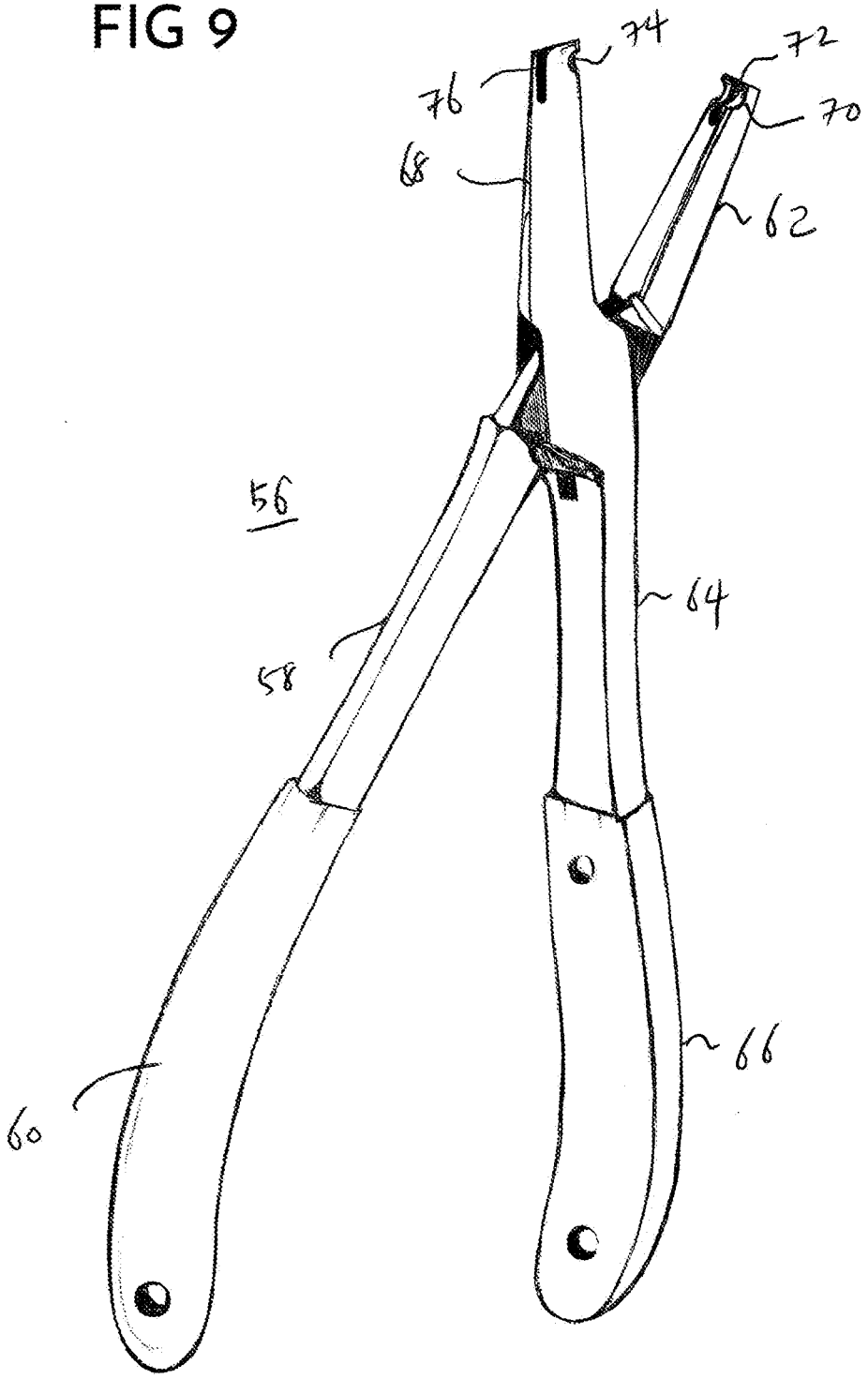
FIG. 9 is a perspective view showing a hair extension tube opening tool.
Figure 10:
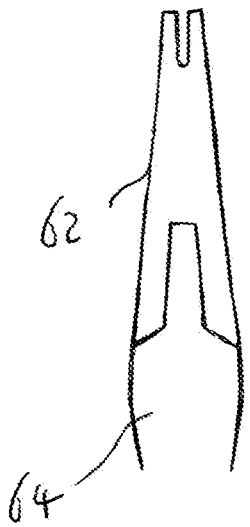
FIG. 10 is a partial side elevation view of the hair extension tube opening tool.
Figure 11:
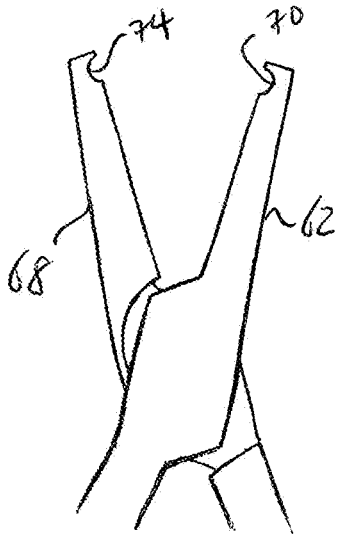
FIG. 11 is a partial front elevation view of the hair extension tube opening tool in open state.
Figure 12:
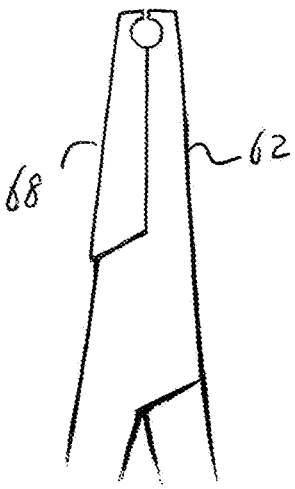
FIG. 12 is a partial front elevation view of the hair extension tube opening tool in closed state.
Figure 13:
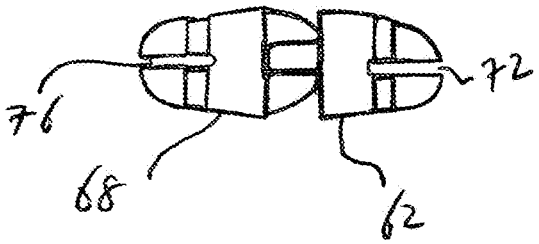
FIG. 13 is a partial top view of the hair extension tube opening tool in open state.
Figure 14:
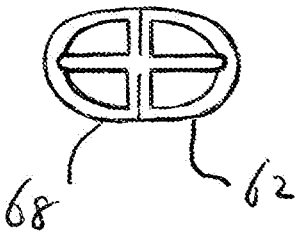
FIG. 14 is a partial top view of the hair extension tube opening tool in closed state.

Referring to FIGS. 3-5, a hair weft 46 is fixed to the hair extension anchor fastening device 10 by inserting the wire 24 into a recess 54 of a fastening pin 48, which is fixed onto the hair weft 46. The fastening pin 48 comprises a flat base 51, an irreversible hook 52 which extends from the base 51, and a lock hook 53 which is provided between the base 51 and the irreversible hook 52. The irreversible hook 52 is elastic to allow entry of the wire 24 into the recess 54. The lock hook 53 is located above the irreversible hook 52, to prevent excess movement of the wire 24. The gap t between the end of the lock hook 53 and the irreversible hook 52 is smaller than the diameter of the wire 24. Referring to FIGS. 6-8, another fastening pin 80 comprises a flat base 82, an irreversible hook 84 which extends from the base 82, and a lock hook 86 which is provided between the base 82 and the irreversible hook 84.

Referring to FIGS. 9-14, the present invention also provides a hair extension tube opening tool 56 that is customized to open or un-squeeze the hair anchor tube 12. The hair extension tube opening tool 56 comprises a first half 58, which comprises a first handle 60 and a first tool tip 62 and a second half 64, which comprises a second handle 66 and a second tool tip 68. The first half 58 and the second half 64 are pivotally connected. The first tool tip 62 contacts the second tool tip 68 when the hair extension tube opening tool 56 is in a closed state (refer to FIGS. 12 and 14). The first tool tip 62 pivots away from the second tool tip 68 when the hair extension tube opening tool 56 is in an open state (refer to FIGS. 11 and 13). The first tool tip 62 comprises a first semi-circular recess 70 and a first slot 72 positioned about the center of the first semi-circular recess 70, and the second tool tip 68 comprises a second semi-circular recess 74 and a second slot 76 positioned about the center of the first semi-circular recess 70. The wire 24 is received in the first slot 72 and the second slot 76 and does not interfere with the first semi-circular recess 70 and the second semi-circular recess 74. After a certain time has elapsed since the hair extension is attached, the hair anchor tubes 12 may be opened in this way to move the hair extension anchor fastening device upward 10 and retighten.

Figure 15:
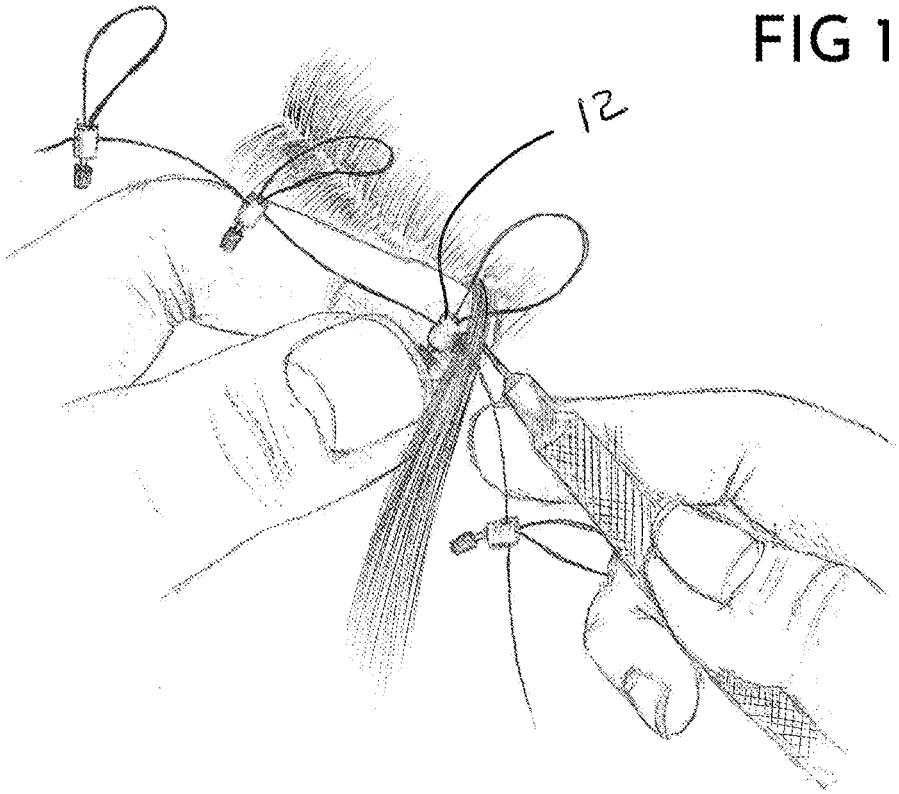
FIGS. 15-18 are schematic perspective views showing a method of using the hair extension anchor fastening device.
Figure 16:
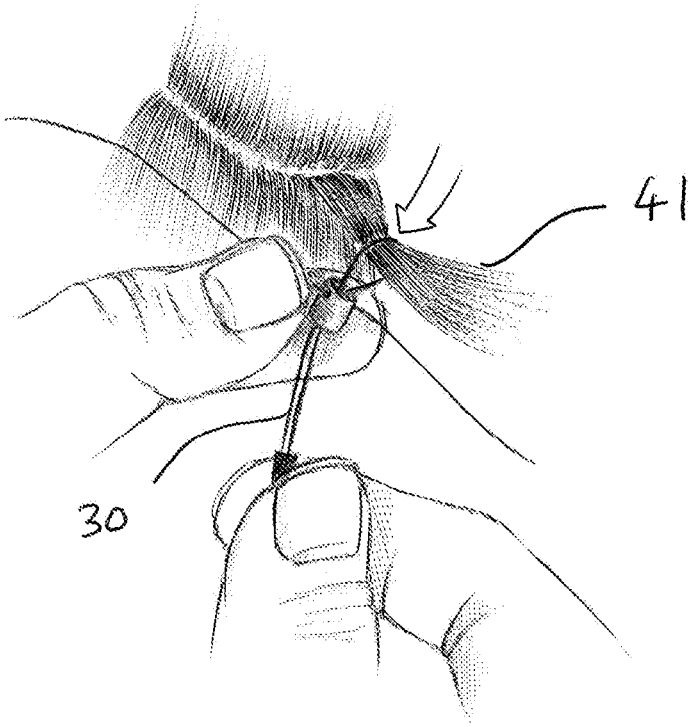
Figure 17:
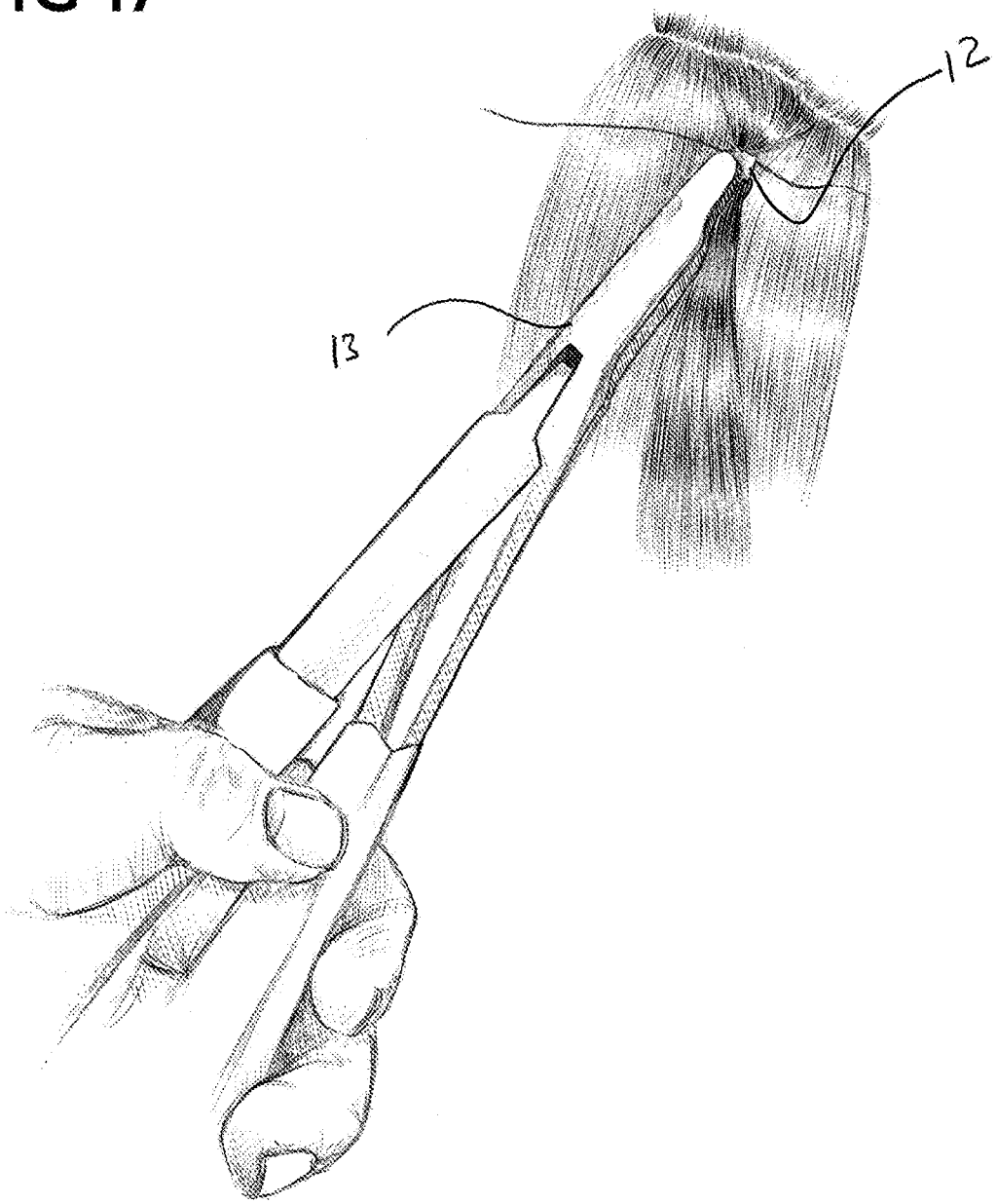
Figure 18:
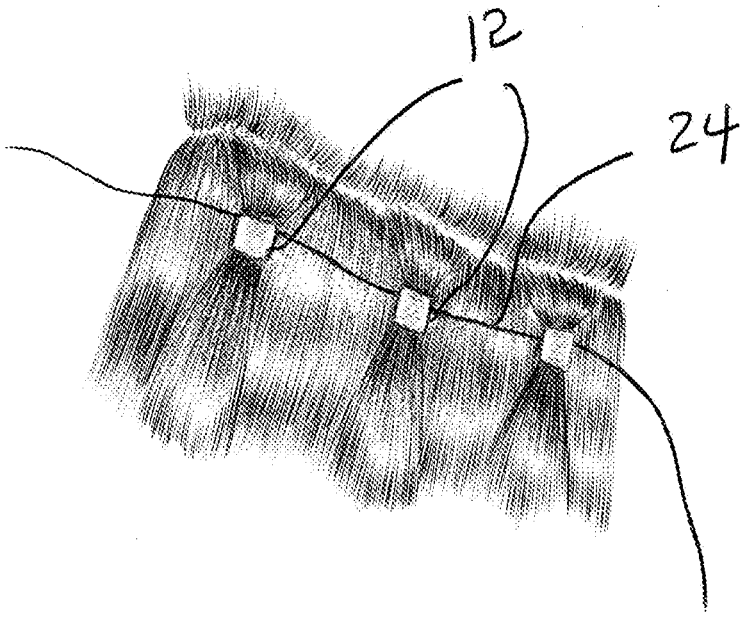

Referring FIGS. 15-18, a method of using the hair extension anchor fastening device 10 is explained. Referring to FIG. 15, a hair stylist decides the center of a customer's hair on which a hair extension is to be attached and puts the hair anchor tube 12 positioned around the center of the hair extension anchor fastening device 10 to the center of the customer's hair. Referring to FIG. 16, the customer's natural hair strands 41 are pulled through the hair anchor tube 12. Referring to FIG. 17, the hair anchor tube 12 is positioned close to the scalp, and the hair anchor tube 12 is squeezed with a plier 13. FIG. 17 shows the squeezed or crimped hair anchor tube 12. Referring to FIG. 18, an adjacent hair anchor tube 12 is positioned about 2 cm away from the crimped hair anchor tube 12 and the same process is repeated. The hair anchor tube 12 freely slides along the wire 24 to naturally and optimally hold the hair strands passed through the hair anchor tube 12. FIG. 18 shows that many hair anchor tubes 12 are positioned along the wire 24 and squeezed to hold the customer's hair strands.

Figure 19:
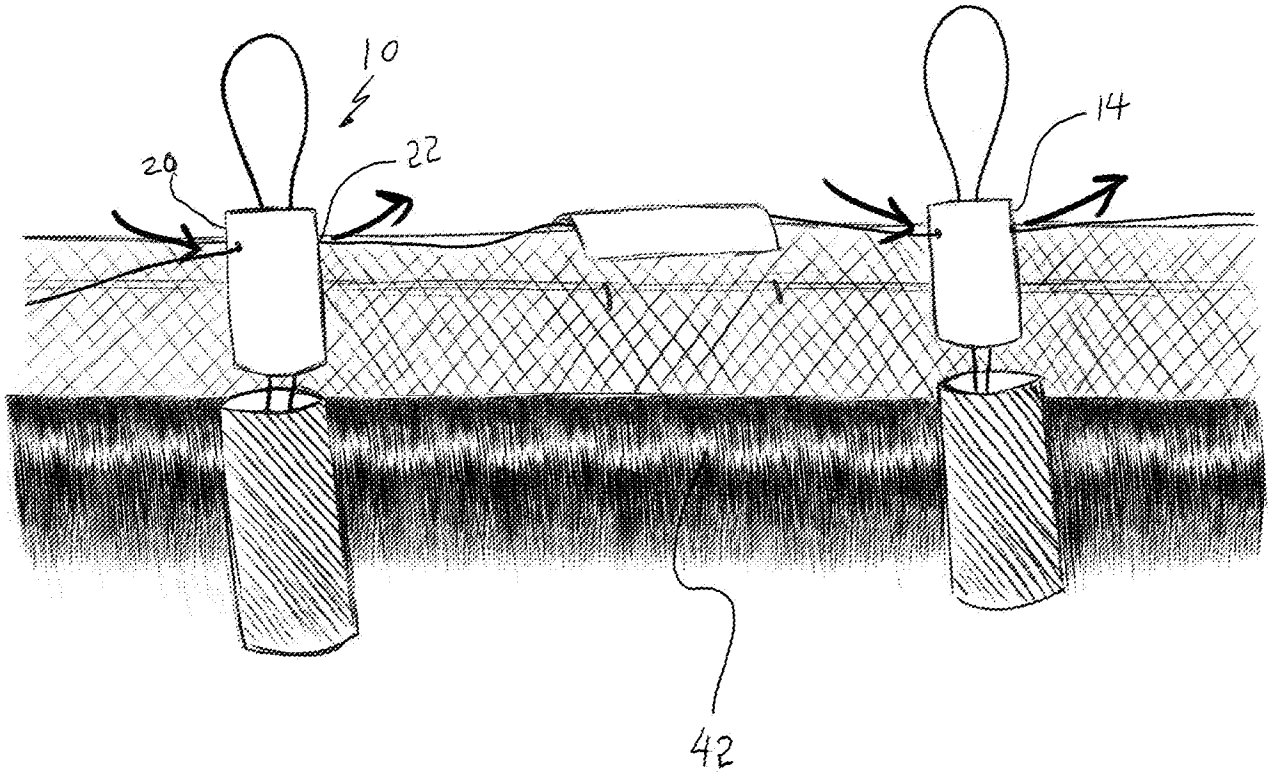
FIG. 19 is a partial front elevation view of the hair extension showing that the hair weft is fixed to the hair extension anchor fastening device by sewing.

FIG. 19 shows that the hair weft 46 is fixed to the hair extension anchor fastening device 10 by sewing the weft band 42 through the first hole 20 and the second hole 22 of the tube wall 14.

Although the hair extension attachment device and methods according to exemplary embodiments of the present invention, have been described in detail hereinabove, it should be understood that many variations and modifications of the basic inventive concept herein described, which may appear to those skilled in the art, will still fall within the spirit and scope of the exemplary embodiments of the present invention as defined by the appended claims.

The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

The invention claimed is:

1. A hair extension anchor fastening device comprising:

a first hair anchor tube comprising a first tube wall, a first top opening and a first bottom opening, wherein the first tube wall comprises a first hole and a second hole which is opposite to the first hole, wherein the first hole and the second hole are located at a predetermined distance from the first top opening;

a second hair anchor tube comprising a second tube wall, a second top opening and a second bottom opening, wherein the second tube wall comprises a third hole and a fourth hole which is opposite to the third hole, wherein the third hole and the fourth hole are located at the predetermined distance from the second top opening; and a wire for passing through the first hole and the second hole of the first hair anchor tube, and through the third hole and the fourth hole of the second hair anchor tube, wherein the first hair anchor tube and the second hair anchor tube are configured to move toward or away from each other, along a length of the wire.

2. The hair extension anchor fastening device of claim 1, wherein the predetermined distance is one third of the first tube wall's height.

3. The hair extension anchor fastening device of claim 1, wherein the first hair anchor tube is made of malleable metal.

4. The hair extension anchor fastening device of claim 1, wherein the wire is made of metal or plastic.

5. The hair extension anchor fastening device of claim 1, further comprising stoppers which are located at both ends of the wire, wherein the stoppers prevent the first hair anchor tube from falling off from the wire.

6. The hair extension anchor fastening device of claim 1, further comprising at least one hair-fixing device, wherein the hair-fixing device comprises a bead thread forming a loop with a bead handle that connects both ends of the bead thread, wherein the bead thread passes through the first hair anchor tube, vertically.

7. The hair extension anchor fastening device of claim 6, wherein the loop of the at least one hair fixing device extends out of the first top opening of the first hair anchor tube, and wherein the bead handle is positioned below the first bottom opening of the first hair anchor tube.

8. A hair extension comprising:

(a) at least one hair weft, wherein the at least one hair weft comprises a plurality of extension hair strands, and a weft band that holds the extension hair strands; and (b) a hair extension anchor fastening device, wherein the hair extension anchor fastening device comprises:

(i) at least one hair anchor tube comprising a tube wall, wherein the tube wall comprises a top opening, a bottom opening, a first hole and a second hole that is opposite to the first hole, wherein the first hole and the second hole are located at a predetermined distance from the bottom opening, (ii) a wire configured to pass through the first hole and the second hole of the at least one hair anchor tube, (iii) at least one hair fixing device, wherein the at least one hair fixing device comprises a bead thread forming a loop with a bead handle that connects both ends of the bead thread, wherein the bead thread passes through the hair anchor tube, and wherein the at least one hair weft is configured to be fixed to the hair extension anchor fastening device.

9. The hair extension of claim 8, wherein the at least one hair weft is fixed to the hair extension anchor fastening device by sewing the weft band through the first hole and the second hole of the tube wall.

10. The hair extension of claim 8, wherein the at least one hair weft is fixed to the hair extension anchor fastening device by inserting the wire into a recess of a fastening pin, which is fixed onto the hair weft.

11. The hair extension of claim 10, wherein the fastening pin comprises a flat base, an irreversible hook which extends from the base, and a lock hook which is provided between the base and the irreversible hook.

12. The hair extension of claim 11, wherein a gap between the end of the lock hook and the irreversible hook is smaller than the diameter of the wire.

13. A hair extension comprising:

a first tube comprising a first tube wall, a first top opening and a first bottom opening, wherein the first tube wall comprises a first hole and a second hole which is opposite to the first hole;

a second tube comprising a second tube wall, a second top opening and a second bottom opening, wherein the second tube wall comprises a third hole and a fourth hole which is opposite to the third hole;

a wire for passing through the first hole and the second hole of the first anchor tube, and through the third hole and the fourth hole of the second anchor tube;

at least one hair fixing device, wherein the at least one hair fixing device comprises a thread forming a loop with a handle coupled to both ends of the thread, the loop being configured to receive natural hair, wherein the thread is configured to pass through the tube, a plurality of extension hair strands; and a band for holding the extension hair strands, wherein the band is configured to be coupled to at least one of the first tube or the wire.

14. The hair extension of claim 13, wherein the band is configured to be sewn to the first hole and the second hole of at least the first hair anchor tube.

15. The hair extension of claim 13 further comprising a clip for coupling the band to the wire.

* * * * *